US006244181B1

(12) United States Patent
Leenders et al.

(10) Patent No.: US 6,244,181 B1
(45) **Date of Patent: *Jun. 12, 2001**

(54) DRY METHOD FOR PREPARING A THERMAL LITHOGRAPHIC PRINTING PLATE PRECURSOR

(75) Inventors: Luc Leenders, Herentals; August Meisters, Gentbrugge, both of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

This patent is subject to a terminal disclaimer.

(21) Appl. No.: 09/345,778

(22) Filed: Jul. 1, 1999

Related U.S. Application Data

(60) Provisional application No. 60/101,034, filed on Sep. 18, 1998.

(30) Foreign Application Priority Data

Jul. 16, 1998 (EP) ..... 98202381

(51) Int. Cl.[7] ..... B41C 1/10
(52) U.S. Cl. ..... 101/467; 101/457
(58) Field of Search ..... 101/457, 462, 101/463.1, 466, 467, 478

(56) References Cited

U.S. PATENT DOCUMENTS

| | | | | |
|---|---|---|---|---|
| 3,619,157 | * | 11/1971 | Brinckman | 101/467 |
| 3,921,527 | * | 11/1975 | Raschke et al. | 101/463.1 |
| 3,945,318 | * | 3/1976 | Landsman | 101/467 |
| 4,245,003 | * | 1/1981 | Oransky et al. | 101/467 |
| 4,711,834 | * | 12/1987 | Butters et al. | 430/302 |
| 5,129,321 | | 7/1992 | Fadner | 101/467 |
| 5,155,003 | * | 10/1992 | Chang | 430/200 |
| 5,254,421 | * | 10/1993 | Coppens et al. | 101/465 |
| 5,713,287 | * | 2/1998 | Gelbart | 101/467 |

FOREIGN PATENT DOCUMENTS

| | | | |
|---|---|---|---|
| 2195826 | * | 7/1997 | (CA) . |
| 37 13 801 A1 | | 11/1988 | (DE) . |
| 0 099 264 A2 | | 1/1984 | (EP) . |
| 0 786 337 A2 | | 7/1997 | (EP) . |
| 0 786 337 A3 | | 2/1998 | (EP) . |

OTHER PUBLICATIONS

Patent Abstracts of Japan, vol. 010, No. 029 (M–451), Feb. 5, 1986 & JP 60 184888 A (Daicel Kagaku Kogyo KK), Sep. 20, 1985.

* cited by examiner

*Primary Examiner*—Stephen R. Funk
(74) *Attorney, Agent, or Firm*—Breiner & Breiner

(57) ABSTRACT

A method is provided for preparing a negative working lithographic printing plate precursor by applying a dry powder, containing a light absorbing compound in an amount not less than 50% by weight, on a metal support such as an anodized aluminum plate. The light absorbing compound is preferably carbon, soot or an infrared dye. In one embodiment of the invention, the dry powder may be rubbed in on the surface of the metal support. In another embodiment a layer of soot is applied on the metal support by contacting the surface of the support with a flame. In still another embodiment, a metal support is contacted with a transfer material consisting of a support and a dry layer of a light absorbing compound such as carbon. By applying heat or light, the dry powder is converted into a hydrophobic substance at the printing areas of the plate. The materials obtained by these methods are very suitable for computer-to-plate and computer-to-press applications as they can be processed by applying plain water, ink or fountain solution. Since the dry powder is preferably free from other reactive compounds besides the light absorbing compound, the materials are characterized by an excellent stability.

14 Claims, No Drawings

DRY METHOD FOR PREPARING A THERMAL LITHOGRAPHIC PRINTING PLATE PRECURSOR

RELATED APPLICATION

The present application claims benefit of Provisional Application No. 60/101,034 filed Sep. 18, 1998.

FIELD OF THE INVENTION

The present invention relates to a method for making a heat-mode lithographic printing plate precursor and a lithographic printing master in computer-to-plate and computer-to-press procedures.

BACKGROUND OF THE INVENTION

Rotary printing presses use a so-called master such as a printing plate which is mounted on a cylinder of the printing press. The master carries an image which is defined by the ink accepting areas of the printing surface and a print is obtained by applying ink to said surface and then transferring the ink from the master onto a substrate, which is typically a paper substrate. In conventional lithographic printing, ink as well as an aqueous fountain solution are fed to the printing surface of the master, which is referred to herein as lithographic surface and consists of oleophilic (or hydrophobic, i.e. ink accepting, water repelling) areas as well as hydrophilic (or oleophobic, i.e. water accepting, ink repelling) areas.

Printing masters are generally obtained by the so-called computer-to-film method wherein various pre-press steps such as typeface selection, scanning, color separation, screening, trapping, layout and imposition are accomplished digitally and each color selection is transferred to graphic arts film using an image-setter. After processing, the film can be used as a mask for the exposure of an imaging material called plate precursor and after plate processing, a printing plate is obtained which can be used as a master.

In recent years the so-called computer-to-plate method has gained a lot of interest. This method, also called direct-to-plate method, bypasses the creation of film because the digital document is transferred directly to a plate precursor by means of a so-called plate-setter. In the field of such computer-to-plate methods the following improvements are being studied presently (i) On-press imaging. A special type of a computer-to-plate process, involves the exposure of a plate precursor while being mounted on a plate cylinder of a printing press by means of an image-setter that is integrated in the press. This method may be called 'computer-to-press' and printing presses with an integrated image-setter are sometimes called digital presses. A review of digital presses is given in the Proceedings of the Imaging Science & Technology's 1997 International Conference on Digital Printing Technologies (Non-Impact Printing 13). Computer-to-press methods have been described in e.g. EP-A 770 495, EP-A 770 496, WO 94001280, EP-A 580 394 and EP-A 774 364. The best known imaging methods are based on ablation. A problem associated with ablative plates is the generation of debris which is difficult to remove and may disturb the printing process or may contaminate the exposure optics of the integrated image-setter. Other methods require processing with chemicals which may damage the electronics and other devices of the press.

(ii) On-press coating. Whereas a plate precursor normally consists of a sheet-like support and one or more functional coatings, computer-to-press methods have been described wherein a composition, which is capable to form a lithographic surface upon image-wise exposure and optional processing, is provided directly on the surface of a plate cylinder of the press. EP-A 101 266 describes the coating of a hydrophobic layer directly on the hydrophilic surface of a plate cylinder. After removal of the non-printing areas by ablation, a master is obtained. However, ablation should be avoided in computer-to-press methods, as discussed above. U.S. Pat. No. 5,713,287 describes a computer-to-press method wherein a so-called switchable polymer such as tetrahydro-pyranyl methylmethacrylate is applied directly on the surface of a plate cylinder. The switchable polymer is converted from a first water-sensitive property to an opposite water-sensitive property by image-wise exposure. The latter method requires a curing step and the polymers are quite expensive because they are thermally unstable and therefore difficult to synthesize. EP-A 802 457 describes a hybrid method wherein a functional coating is provided on a plate support that is mounted on a cylinder of a printing press. This method also needs processing. A major problem associated with known on-press coating methods is the need for a wet-coating device which needs to be integrated in the press.

(iii) Thermal imaging. Most of the computer-to-press methods referred to above use so-called thermal materials, i.e. plate precursors or on-press coatable compositions which comprise a compound that converts absorbed light into heat. The heat which is generated on image-wise exposure triggers a (physico-)chemical process, such as ablation, polymerization, insolubilization by cross-linking of a polymer, decomposition, or particle coagulation of a thermoplastic polymer latex. This heat-mode process then results in a lithographic surface consisting of ink accepting and ink repelling areas. In addition to some of the disadvantages of the prior art materials and methods, indicated above, a major problem associated with all the known non-ablative thermal materials is the limited shelf life. Because these materials all contain one or more reactive compounds, the stability is highly dependent on temperature and/or humidity conditions during storage.

(iv) Elimination of chemical processing. The development of functional coatings which require no processing or may be processed with plain water, ink or fountain solution is another major trend in plate making. WO 90002044, WO 91008108 and EP-A 580 394 disclose such plates, which are, however, all ablative plates. In addition, these methods require typically multi-layer materials, which makes them less suitable for on-press coating. A non-ablative plate which can be processed with plain water is described in e.g. EP-A 770 497 and EP-A 773 112. Such plates also allow on-press processing, either by wiping the exposed plate with water while being mounted on the press or by the ink or fountain solution applied during the first runs of the printing job.

EP-A 786 337 describes a method wherein dry powder, especially toner, is applied to a support. The dry powder is then molten image-wise and removed at non-exposed areas by a mechanical or electrostatic processing device. The latter step is necessary because the exposure does not convert the powder from a hydrophilic to an oleophilic state (or vice-versa) but only changes the adherence of the powder to the support by melting said powder. Such a processing device is difficult to implement in a printing press.

Another problem associated with most thermal materials disclosed in the prior art is that these materials are suitable for exposure with either an internal drum image-setter (i.e. typically a high-power short-time exposure) or an external drum image-setter (i.e. relatively low-power long-time exposure). Providing a universal material that can be exposed with satisfactory results on both these types of laser devices known in the art is a requirement difficult to fulfill.

SUMMARY OF THE INVENTION

It is an object of the present invention to provide a cost effective method for preparing a material which is suitable for making a printing master for conventional lithographic printing by using computer-to-plate, computer-to-press or on-press coating methods and which requires no processing or can be processed on-press by applying plain water, ink or fountain solution. It is a particular object of the present invention to provide a method for making a heat-mode material which is characterized by an excellent stability thereby guaranteeing a long shelf life. It is still another object of the present invention to provide a method for making a universal material which can be exposed with internal as well as external drum image-setters. The above objects are realized by the method specified in the claims. Preferred embodiments of the method according to the present invention are specified in the dependent claims.

Further advantages and embodiments of the present invention will become apparent from the following description.

DETAILED DESCRIPTION OF THE INVENTION

Methods have been described in the prior art using heat-mode materials wherein a light absorbing compound acts as a light-to-heat convertor and wherein the heat generated upon exposure triggers reactive compounds to undergo a (physico-)chemical reaction. Due to the presence of reactive compounds), care must be taken with regard to storage conditions to guarantee a long shelf life of the material. In such materials the light absorbing compound is present in a typical amount relative to all the compounds in the material, excluding the support, of 1 to 10% by weight.

It is surprising that, according to the present invention, the presence of other reactive compounds besides the light absorbing compound is not essential and an imaging material, which is suitable for making a lithographic printing master, may be obtained by applying on a metal support a dry powder which contains a light absorbing compound in an amount not less than 50% by weight relative to the dry powder and which is preferably substantially free from other reactive compounds besides the light absorbing compound.

In addition to this surprising effect, the materials made by the method of the present invention require no processing or can be processed by applying plain water, ink or fountain solution. Since it is a dry coating method, the method of the present invention is very suitable for computer-to-press applications and on-press coating procedures. Another major benefit of the materials made according to the present invention is the excellent stability : they can be stored during 2 minutes at 100° C. without toning (accepting ink in non-exposed areas), contrary to conventional thermal lithographic printing plate precursors which show significant toning when exposed to the above conditions. Some materials made according to the present invention, especially those comprising carbon as a light absorbing compound, can even be stored during 2 minutes at 150° C. without noticeable toning.

The imaging mechanism of the materials that are made according to the present invention is not known, but may rely on a heat-induced interaction between the light absorbing compound and the metal support. For instance, it was observed that the aluminum signal measured by secondary ion mass spectroscopy while sputtering away the upper 2 nm from the surface of a material, consisting of an anodized aluminum support and a layer consisting exclusively of a light absorbing compound, drops upon image-wise exposure down to 50% or even 10% of the signal measured at unexposed areas, the specific value being highly dependent on the structure of the light absorbing compound used.

The features of the present invention, as specified in the claims, shall be understood as indicated hereafter. The word "image" is used herein in the context of lithographic printing, i.e. a pattern consisting of oleophilic (printing) and hydrophilic (non-printing) areas. The material that is made according to the present invention is negative working, which means that the areas, which are exposed to light, are rendered oleophilic and thus ink accepting due to said exposure. In the context of the present invention, the feature "negative working" may be considered as an equivalent of the feature "non-ablative", since in ablative materials the functional layers are completely removed from the underlying (hydrophilic) metal support upon image-wise exposure so as to obtain a positive image (exposed areas are hydrophilic, ink repelling). Analysis of the exposed areas of the material made according to the method of the present invention indeed showed that the layer or stack of layers is not or only partially removed upon image-wise exposure but, instead, is converted into a hydrophobic surface on the metal support. The unexposed areas are hydrophilic or become hydrophilic after processing with plain water, ink or fountain solution. The exposed areas are oleophilic and form the printing areas of the printing master.

The light absorbing compound is the main compound of the dry powder. The feature "main compound" designates that the compound is present in an amount not less than 50% by weight relative to all the compounds in the dry powder. This feature distinguishes the present invention from prior art methods as described in EP-A 786 337 using toner as a dry powder, since it is well known to the skilled person that toner particles comprise a low amount of light absorbing compound, which is typically about 5% by weight. In a preferred embodiment the amount of light absorbing compound is not less than 70% by weight and even more preferably not less than 90% by weight relative to all the compounds in the dry powder. In a highly preferred embodiment the dry powder consists essentially of a light absorbing compound. Mixtures of light absorbing compounds can also be used, and then, the total amount of all light absorbing compounds relative to all the compounds in the dry powder is not less than 50% by weight, more preferably not less than 70% by weight and even more preferably not less than 90% by weight.

Though the dry powder may comprise other compounds in addition to the light absorbing compound, the amount of other reactive compounds besides the light absorbing compound is preferably less than 20% by weight relative to the dry powder. The feature "reactive compound" shall be understood as a compound which undergoes a (physico-) chemical reaction due to the heat generated during image-wise exposure. Examples of such reactive compounds are thermoplastic polymer latex, diazo resins, naphtoquinone diazide, photopolymers, resole and novolac resins, or modified poly(vinyl butyral) binders. More examples can be found in J. Prakt. Chem. Vol. 336 (1994), p. 377–389.

More preferably the amount of said other reactive compounds in the dry powder is less than 10% by weight and most preferably, the dry powder is substantially free from reactive compounds other than the light absorbing compound. The words "substantially free" shall be understood as meaning that a small ineffective amount of such reactive compounds may be present in addition to the light absorbing compound. Said small ineffective amount is not essential for or does not significantly contribute to the imaging process of the material made according to the present invention. This can be tested easily by preparing a material without said small amount of reactive compounds and establishing whether the material thus obtained can still be used to make a printing master. The threshold value below which the amount of the other reactive compounds, besides the light absorbing compound, may be regarded as "ineffective" depends on the nature of the reactive compounds.

The dry powder used in the present invention may further comprise non-reactive compounds, i.e. inert components such as e.g. a binder, a matting agent or a filler. The word "inert" shall not be understood in the meaning of "non-functional", since these inert compounds may be added to the powder to adjust certain physical properties, such as e.g. surface roughness and friction coefficient of the applied layer or the rheological properties of the powder. The word "inert" shall rather be understood as meaning "not essential for the imaging process", though some inert compounds may have a (minor) influence on the speed and image quality of the material.

Examples of such inert compounds are hydrophilic binders, e.g. carboxymethyl cellulose, homopolymers and copolymers of vinyl pyrrolidone, vinyl alcohol, acrylamide, methylol acrylamide, methylol methacrylamide, acrylic acid, methacrylic acid, hydroxyethyl acrylate, hydroxyethyl methacrylate or maleic anhydride/vinylmethylether copolymers. The amount of hydrophilic binder in the layer applied on the metal support is preferably less than 40% by weight and more preferably between 5 and 20% by weight.

The method of the present invention may be used to apply a stack of layers on a metal support but a single layer is preferred. The light absorbing compound may be present in all the layers of said stack or may be localized in just a single layer of said stack. In a method according to the latter embodiment the layer comprising the light absorbing compound is preferably applied directly on the metal support. The layer comprising the light absorbing compound is preferably very thin, i.e. having a dry layer thickness not higher than 1 $\mu$m, preferably not higher than 0.5 $\mu$m and even more preferably ranging from 0.1 to 0.25 $\mu$m. A layer thickness below 0.1 $\mu$m may still give satisfactory results. For instance, it was observed that an anodized aluminum support provided with a 0.1 $\mu$m layer consisting of finely divided carbon particles, which was then cleaned by wiping thoroughly with a dry cloth and image-wise exposed with an infrared laser, still provides an excellent printing master. The latter example shows that it may be sufficient to fill the pores present in an anodized aluminum support with light absorbing powder in order to obtain a material having the benefits of the present invention.

The support used in the present invention is a metal support. Preferred examples of said metal support are steel, especially polished stainless steel, and aluminum. Phosphor bronze (an alloy comprising >90 wt. % of copper, <10 wt. % of tin and small amounts of phosphor) can also be used. The aluminum support is preferably an electrochemically grained and anodized aluminum support. Most preferably said aluminum support is grained in nitric acid, yielding imaging elements with a higher sensitivity. The anodized aluminum support may be treated to improve the hydrophilic properties of its surface. For example, the aluminum support may be silicated by treating its surface with sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with a citric acid or citrate solution. This treatment may be carried out at room temperature or can be carried out at a slightly elevated temperature of about 30 to 50° C. A further treatment may involve rinsing the aluminum oxide surface with a bicarbonate solution. Still further, the aluminum oxide surface may be treated with poly(vinyl phosphonic acid), poly(vinyl methylphosphonic acid), phosphoric acid esters of poly (vinyl alcohol), poly(vinyl sulphonic acid), poly(vinyl benzenesulphonic acid), sulphuric acid esters of poly(vinyl alcohol), and acetals of poly(vinyl alcohols) formed by reaction with a sulphonated aliphatic aldehyde. It is evident that one or more of these post treatments may be carried out alone or in combination.

A highly preferred material made according to the present invention comprises an anodized aluminum support and provided directly thereon a single recording layer which consists essentially of a light absorbing compound and is substantially free from other reactive compounds. On top of said recording layer there may be provided a top layer for protecting the recording layer against moisture, chemicals, oxygen, mechanical impact, etc.

The light absorbing compound used in the present invention is a compound which is capable of converting light into heat. Useful compounds are for example organic dyes, carbon black, graphite, metal carbides, borides, nitrides, carbonitrides, or oxides.

The materials made by the method of the present invention are preferably sensitive to near infrared light. Accordingly, the light absorbing compound is preferably a near infrared light absorbing compound such as carbon or an infrared dye. It is also possible to use dry, finely divided polymer particles consisting of e.g. a polypyrrole or polyaniline-based polymer. The infrared dyes listed in Table 1 are highly preferred.

TABLE 1

Cpd 1

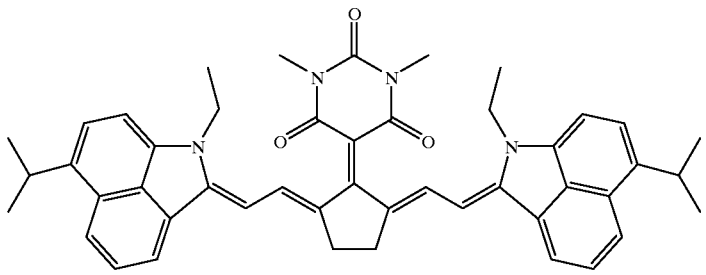

TABLE 1-continued
Cpd 2
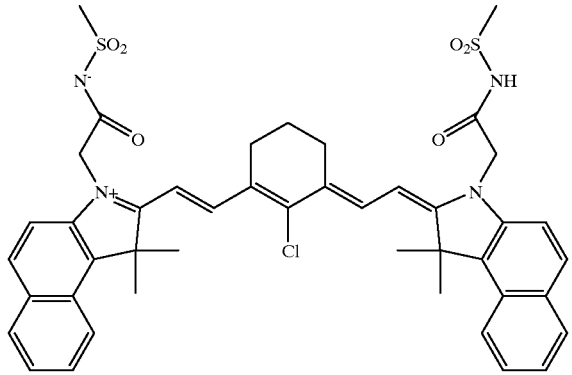
Cpd 3
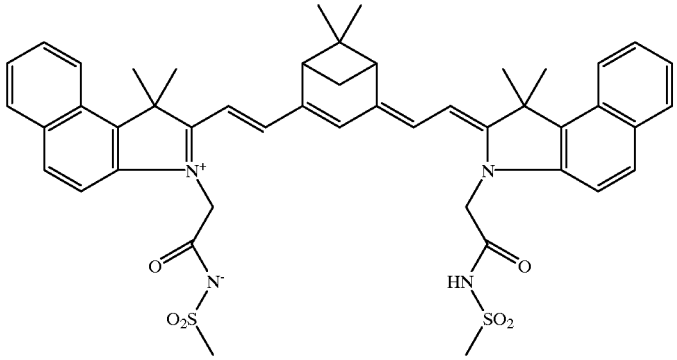
Cpd 4
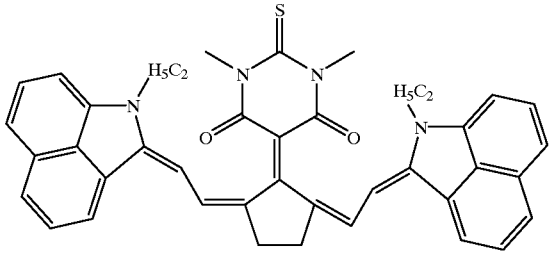
Cpd 5
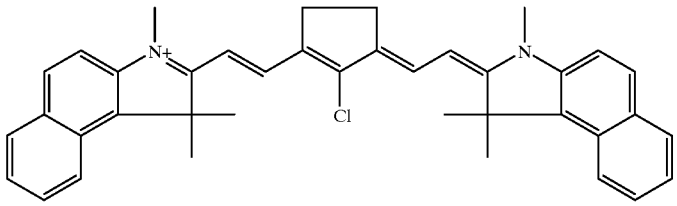
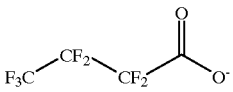

TABLE 1-continued
Cpd 6
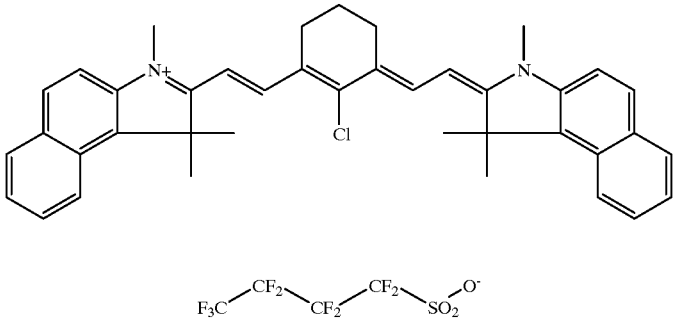
Cpd 7
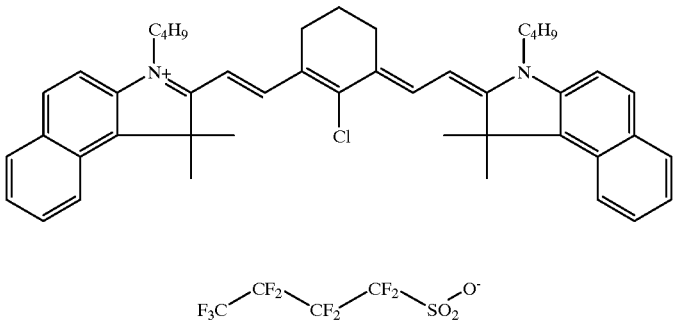
Cpd 8
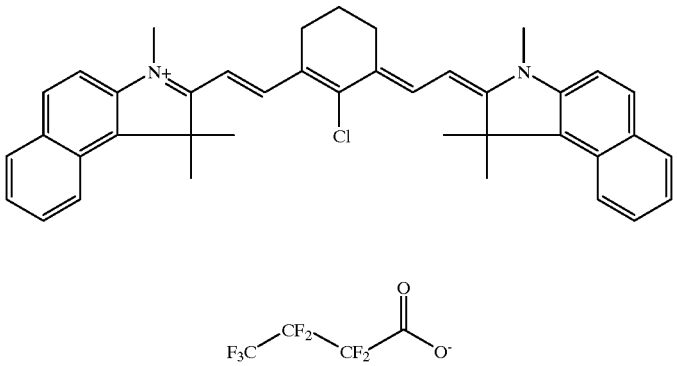
Cpd 9
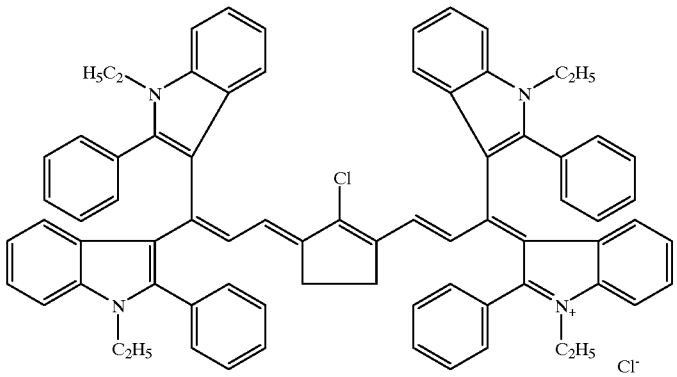

TABLE 1-continued

Cpd 10

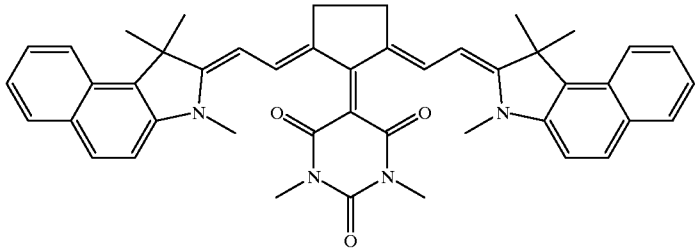

Cpd 11

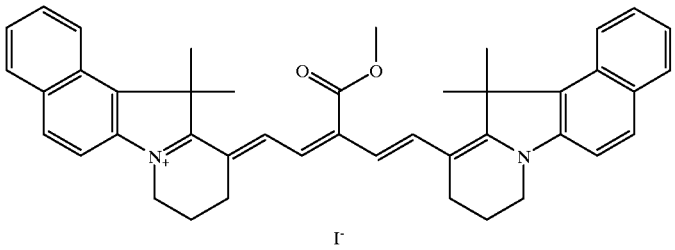

In one embodiment of the present invention the dry powder consists of or comprises soot as a light absorbing compound, i.e. the black carbon obtained from the incomplete combustion of organic materials such as oils, wood, natural gas, acetylene, coal, wax or cork. Said soot may even be applied to the metal support by contacting a surface of said support with a flame obtained by burning said organic material. Preferably the surface of the metal support is contacted with the colder part of the flame where combustion is incomplete, e.g. the yellow end of the flame of a candle. Electron microscopic images of materials made in this way show a uniform coating of submicron soot particles.

According to the present invention, a metal support can be applied with a dry powder by rubbing in the surface of said support with a light absorbing compound, e.g. carbon or an organic dye. Alternative dry coating methods can also be used, e.g. sputter-coating of carbon on the metal support or direct electrostatic printing (toner jet). The latter technique can be used to apply the dry powder image-wise on a metal support and after intense overall heating, e.g. by infrared laser exposure, a printing master is obtained. Said infrared laser can be mounted on the same carriage as the direct electrostatic printing head.

The method of the present invention can be used in computer-to-plate (off-press exposure) or computer-to-press (on-press exposure) procedures. The method may also involve on-press coating, i.e. applying a dry powder according to the present invention directly on the metal surface of a cylinder of a rotary printing press. Said on-press coating can also be performed indirectly by applying the dry powder on a metal support which is mounted on a cylinder of a rotary printing press. In still another method according to the present invention, said composition can be applied on a metal sleeve which, after image-wise exposure and optional processing, is then transferred to a cylinder of a rotary printing press.

The dry powder may also be applied on the metal support by contacting the surface of said support with another material, which carries a dry layer containing a light absorbing compound which is then transferred to the metal support. The method of this embodiment can be automated easily, e.g. by incorporating a supply roll of such a transfer material, such as a ribbon impregnated with light absorbing compound, in a print station of a digital press similar to the configuration which is described EP-A 698 488. The transfer material can be unwound from said supply roll and the layer containing the light absorbing compound can then be brought in direct contact with the surface of a plate cylinder by one or more contact rollers. After the transfer step, which may be carried out by applying pressure and/or heat on said transfer material while being in contact with the metal support, the used transfer material may be wound up again on a take-up roll. In the latter embodiment, the transfer of dry power can be carried out so as to obtain a uniform layer which then can be image-wise exposed. Alternatively said pressure and/or heat can be applied image-wise, so that the light absorbing compound is transferred image-wise to the metal support. This step then may be followed by intense overall heating, e.g. by infrared laser exposure. However, if sufficient heat is applied during said image-wise transfer, a suitable printing master may directly be obtained without intense overall heating.

In an even more preferred embodiment of the automated method, described above, a dry coating unit as described above, consisting of a supply roll, one or more contact rollers and a take-up roll, is mounted on the same carriage as the laser exposure unit of an external drum image-setter. Reference is made to e.g. FIG. 1 of U.S. Pat. No. 5,713,287 which illustrates a similar device wherein a spray coating unit is mounted on the same carriage as the laser exposure unit in an external drum configuration. In this way, said dry coating unit moves in front of the laser exposure unit along the so-called slow scan axis, parallel to the axis of the plate cylinder. As the plate cylinder is rotated during image-wise exposure (fast scan movement), the whole surface of said cylinder passes the dry coating unit and a layer is coated along a spiral path around the cylinder. Since the laser exposure unit moves together with the dry coating unit, an area which has been coated during one revolution of the cylinder is exposed by the laser exposure unit a number of revolutions later, i.e. coating and image-wise exposing can be carried out almost simultaneously during the same scan procedure.

The materials made according to the present invention can be exposed to light by a light emitting diode or a laser such as a He/Ne or Ar laser. Preferably a laser emitting near infrared light having a wavelength in the range from about 700 to about 1500 nm is used, e.g. a semiconductor laser diode, a Nd:YAG or a Nd:YLF laser. The required laser power depends on the pixel dwell time of the laser beam, which is determined by the spot diameter (typical value of modern plate-setters at $1/e^2$ of maximum intensity: 10–25 $\mu$m), the scan speed and the resolution (i.e. the number of distinct pixels per unit of linear distance, often expressed in dots per inch or dpi; typical value: 1000–4000 dpi). A major benefit of the materials made according to the present invention is that they can be used as a universal imaging material which is suitable for exposure by internal (ITD) as well as external drum (XTD) image-setters. ITD image-setters are typically characterized by very high scan speeds up to 500 m/sec and may require a laser power of several Watts. Satisfactory results have also been obtained by using XTD image-setters having a typical laser power from 100 mW to 500 mW at a lower scan speed, e.g. from 0.1 to 10 m/sec.

The unexposed areas of the material made according to the present invention can be removed easily by applying plain water, ink or fountain solution to the material. This step may be performed on-press, i.e. after mounting the exposed plate on the plate cylinder of a printing press. The materials can even be used as a printing master immediately after image-wise exposure without any additional processing because the unexposed areas are readily removed by the fountain solution or the ink applied during the first runs of the printing job. It is evident that the step of processing the material can be omitted when the layer of dry powder is a non-contiguous layer, obtained by applying said powder image-wise as described above. In the latter method, no powder is present in non-image areas and as a result, the processing step may be omitted.

Most printing plates described in the prior art require a so-called post-bake, i.e. an overall heating treatment after image-wise exposure and optional processing so as to increase the run length of the plate. The materials made according to the present invention allow to achieve satisfactory run lengths without a post-bake.

EXAMPLES

While the present invention will hereinafter be described in connection with preferred embodiments thereof, it will be understood that it is not intended to limit the invention to those embodiments.

Example 1

One surface of an anodized aluminum support was covered with a soot layer by contacting said surface with the flame of a Bunsen burner fed with natural gas. After coating the whole support, the layer was rubbed off with a dry cloth so as to obtain a uniform thin layer of soot. The plate precursor thus obtained was image-wise exposed with a Nd:YLF (1060 nm) external drum (XTD) laser having a power of 738 mW and a scan speed of 8.0 m/sec. The plate was mounted on the cylinder of an AB Dick 360 (trade name) printing press and cleaned with a sponge that was moistened with plain water. A print job of 25000 copies was started using Rubber Base Plus VS2329 Universal Black ink, trade name of Van Son, and Tame EC 7035 fountain solution, trade name of Anchor, the latter diluted with water 50-fold. The print quality was very good throughout the press run.

Comparable results were obtained by applying the carbon layer using the following alternative methods:

rubbing in the plate with the ashes of a burned cork; or contacting the plate with the flame of an acetylene burner, a cigarette lighter or a candle; or rubbing in the plate with a piece of graphite or even with a pencil.

A suitable printing master was obtained by image-wise exposing the above layer with the following alternative laser sources :

the same laser as above with a scan speed of 3.2 m/sec; or an XTD diode laser (830 nm) with a laser power of 40 or 80 mW at 1.0 or 2.0 m/sec (four different combinations exposed on different areas of the plate); or an ITD Nd:YLF laser of 7.1 W at 367 m/sec; or an XTD laser diode-array (830 nm) having a combined power of 12 W at 1.2 m/sec.

Example 2

Three plate precursors were prepared by rubbing in the surface of an anodized aluminum plate with a dry powder consisting of Cpd 1, Cpd 4 or Cpd 9 respectively. The samples were image-wise exposed with an XTD Nd:YLF laser (1060 nm) with a power of 150 mW at a scan speed of 2 m/sec. The plates thus obtained were used as a master in a print job using the same press, ink and fountain solution as in Example 1. No special measures were taken to ensure that the layer had a uniform thickness over the whole surface of the plate and it was observed that the plates were completely hydrophobic at the centre, where the coating thickness was the highest, regardless whether the plate had been exposed at that area or not. At the edges, where the layer was much thinner, a good printing quality was obtained with no toning in the non-exposed areas, indicating the a low layer thickness is preferred for these light absorbing compounds.

Example 3

Cpd 2, Cpd 3, Cpd 10 and Cpd 11 were each rubbed in as a dry powder on the surface of an anodized aluminum plate. The four materials thus obtained were image-wise exposed with a XTD laser diode (830 nm) with a power of 60 or 80 mW and a scan speed of 1, 2 or 4 m/sec (six combinations exposed at different areas of each plate). The plates were used as a master in a print job using the same press, ink and fountain solution as in Example 1. All masters provided good printing results over the whole area of the plate.

Having described in detail preferred embodiments of the current invention, it will now be apparent to those skilled in the art that numerous modifications can be made therein without departing from the scope of the invention as defined in the appending claims.

What is claimed is:

1. A method for making a lithographic printing master having printing and non-printing areas, said method comprising the steps of making a non-ablative imaging material by applying a uniform layer of dry powder to a metal support;

exposing said dry powder to heat or light at the printing areas;

optionally removing the dry powder from the metal support at the non-printing areas by applying water, ink or fountain solution;

characterized in that said dry powder comprises not less than 50% by weight of a light absorbing compound.

2. A method according to claim 1 wherein the dry powder comprises not less than 70% by weight amount of light absorbing compound.

3. A method according to claim 1 wherein the dry powder comprises not less than 90% by weight amount of light absorbing compound.

4. A method according to claim 1 wherein the amount of other reactive compounds present in the dry powder, besides the light absorbing compound, is less than 20% by weight.

5. A method according to claim 1 wherein the dry powder is substantially free from other reactive compounds besides the light absorbing compound.

6. A method according to claim 1 wherein the light absorbing compound is a near infrared light absorbing compound.

7. A method according to claim 1 wherein the light absorbing compound is carbon or soot.

8. A method according to claim 1 wherein the step of applying the layer of dry powder to the metal support is carried out by contacting said support with a transfer material having a layer which contains a light absorbing compound.

9. A method according to claim 1 wherein the metal support is an anodized aluminum plate.

10. A method according to claim 9 wherein the anodized aluminum plate is mounted on a cylinder of a rotary printing press.

11. A method according to claim 1 wherein the metal support is a sleeve or a cylinder of a rotary printing press.

12. A method according to claim 1 wherein the thickness of the layer of dry powder is not higher than 1 $\mu$m.

13. A method for making a lithographic printing master having printing and non-printing areas, said method comprising the steps of making a non-ablative imaging material by applying a layer of dry powder to a metal support;

exposing said dry powder to heat or light at the printing areas;

optionally removing the dry powder from the metal support at the non-printing areas by applying water, ink or fountain solution; characterized in that said dry powder comprises not less than 50% by weight of a light absorbing compound;

and wherein the dry powder consists essentially of a light absorbing compound.

14. A method for making a lithographic printing master having printing and non-printing areas, said method comprising the steps of making a non-ablative imaging material by applying a layer of dry powder to a metal support;

exposing said dry powder to heat or light at the printing areas;

optionally removing the dry powder from the metal support at the non-printing areas by applying water, ink or fountain solution; characterized in that said dry powder comprises not less than 50% by weight of a light absorbing compound;

and wherein the step of applying the layer of dry powder to the metal support is carried out by contacting said support with a flame.

* * * * *